US005507893A

United States Patent [19]

Mullay et al.

[11] Patent Number: 5,507,893

[45] Date of Patent: Apr. 16, 1996

[54] STABILIZED MUNITIONS CONTAINING A NENA COMPOUND

[75] Inventors: John J. Mullay, Hazleton; Randal A. Johnson, Hamburg; John F. Van Norman, Tamaqua, all of Pa.

[73] Assignee: ICI Explosives USA Inc., Tamaqua, Pa.

[21] Appl. No.: 210,700

[22] Filed: Mar. 18, 1994

[51] Int. Cl.[6] ..... C06B 29/22

[52] U.S. Cl. ..... 149/76; 149/78; 149/91

[58] Field of Search ..... 149/92, 76, 78

[56] References Cited

U.S. PATENT DOCUMENTS 3,883,374 5/1975 Rosher ..... 149/19.8

4,948,897 8/1990 Riggs ..... 149/92 X 5,325,782 7/1994 Strauss et al. ..... 102/285

*Primary Examiner*—Peter A. Nelson

*Attorney, Agent, or Firm*—Charles Q. Buckwalter

[57] ABSTRACT

Stabilized munitions are provided which comprise ammonium perchlorate and which have been plasticized with a NENA (nitratoethylnitramine) compound. In order to stabilize this system, Lewis base compounds of specified formula are included as part of the munition. Preferred stabilizers include urea, acetamide or nitroguanidine. The stabilized munitions, and in particular, propellants provide improved safety and/or energetic properties over current munition formulations.

22 Claims, No Drawings

STABILIZED MUNITIONS CONTAINING A NENA COMPOUND

FIELD OF THE INVENTION

This invention relates to the energetic materials art, and in particular to explosive munitions or propellants which contain a plasticizer.

DESCRIPTION OF THE RELATED ART

In recent years the military industry has identified a need to develop munitions which are less vulnerable to initiation either by impact of fragments or by heat. There has been a major effort to develop both the hardware and the energetic materials that go into the production of these munitions. A very important class of molecules has been identified in this effort. These materials are known generically as 'NENA' compounds, and incorporate both a nitrate ester and a nitramine group on the same molecule. NENA compounds are categorized as nitratoethylnitramines. Important NENA compounds include the "N-alkyl-N-nitratoethylnitramine" compounds such as the butyl, ethyl and methyl derivatives as well as a dinitrate ester derivative. These compounds are designated, respectively as BuNENA, EtNENA, MeNENA and DINA. The last molecule listed, DINA, includes two nitratoethyl groups, as well as a nitramine grouping.

An important use for these NENA compounds is as a plasticizer in propellants and explosives. In these applications, NENA materials can replace less safe energetic molecules such as nitroglycerin or butanetrioltrinitrate. In addition, they can also replace less energetic materials such as the commonly used mixture of bis(dinitropropyl)acetal and bis(dinitropropyl)formal (BDNPA/F). When used as a plasticizer, NENA materials can offer advantages of increased energy and plasticization over other plasticizers, as well as decreased vulnerability or added safety as compared with the nitrate ester plasticizers.

There is a desire in the industry to use the NENA plasticizers in combination with solid ammonium perchlorate (AP), as this material is a very important oxidizing agent used in, among other things, rocket motors.

However, since NENA materials are relatively new, there are many unknowns that exist with regard to their use in general munitions. Of particular interest with regard to the present invention, is the compatibility of the NENA compounds with ammonium perchlorate.

During routine testing of the mixture of AP with various NENA compounds, described hereinbelow, it was found that the NENA compounds exhibited an incompatibility with solid ammonium perchlorate. This situation could greatly restrict the usefulness of these materials as plasticizers for ammonium perchlorate-containing compositions. This, in turn, could greatly restrict the ability of the industry to utilize these materials as plasticizers when attempting to produce safer munitions. Thus, there is a need to provide a method for improving the compatibility of a mixture of ammonium perchlorate and a NENA compound.

SUMMARY OF THE INVENTION

Accordingly, the present invention provides a composition comprising a mixture of ammonium perchlorate and a NENA compound in combination with a Lewis base stabilizer compound. Preferably, the stabilizer compound is either:

i) a compound of formula I

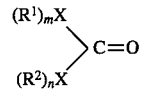

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) a compound of formula II

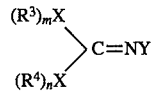

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

The compositions of the present invention may be used wherever a stabilized mixture of ammonium perchlorate and a NENA compound are desired. However, these compositions are preferably utilized in munitions, which term includes both explosives and propellants, and most preferably, these compositions are used in propellants. When utilized in either of these applications, but particularly in munition applications, the compositions of the present invention may also include a high explosive.

High explosives suitable for use in munition applications are known to those skilled in the art, but can include such explosives as HMX (cyclotetramethylene tetranitramine), RDX (cyclo-1,3,5-trimethylene-2,4,6-trinitramine), PETN (pentaerythritol tetranitrate), TNT (trinitrotoluene), TATB (triaminotrinitrobenzene), HNS (hexanitrostilbene). Preferably, however, the high explosive utilized is RDX or HMX.

Accordingly, the compositions of the present invention may be used in the preparation of explosives and propellants, and thus may be utilized in the production of rocket motors, gun propellants, bombs and the like.

It is expected that common ingredients, generally known to those skilled in this art, such as binders or energetic binders as well as other energetic molecules including nitramines or nitrate esters as well as other energetic materials or materials that impart specific properties will also be part of the compositions, or formulations, that would incorporate ammonium perchlorate, NENA materials and the newly identified stabilizing materials, in accordance with the present invention. Further, the compositions may additionally comprise materials such as reaction catalysts, binders, and the like, to control the handling or reaction properties of the final munition formulation.

In a further aspect, the present invention also provides a method for the production of a stabilized composition, and preferably a stabilized munition and/or propellant comprising ammonium perchlorate, a NENA compound, and a stabilizer of formula I or II as described hereinabove. Accordingly, the present invention provides a process for the production of a composition comprising blending a mixture of ammonium perchlorate and a NENA compound selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof, and a stabilizer compound of either:

i) formula I

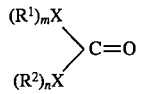

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) formula II

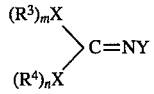

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

DESCRIPTION OF THE PREFERRED EMBODIMENTS

It is envisioned that compounds made in accordance with the present invention will be useful in military munitions which incorporate perchlorates, preferably solid perchlorates, and most preferably solid ammonium perchlorate.

The NENA material selected is of the general class of compounds identified as nitratoethylnitramine compounds or derivatives, and preferably is a N-alkyl-N-nitratoethylnitramine, wherein the alkyl group preferably contains 1 to 10 carbon atoms, or is a nitrate ester derivative. More preferably, the NENA compound is selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof.

The stabilizer compound is either:

i) a compound of formula I

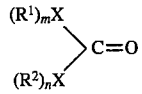

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) a compound of formula II

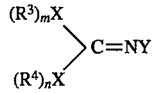

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

Preferred stabilizers of formula I are urea or acetamide, and preferably, the stabilizer of formula II is nitroguanidine. Mixtures of urea, acetamide and/or nitroguanidine are also usable in the present invention.

The levels of each material used in the formulation of the munitions of the present invention will vary depending on the individual materials selected, and on the desired properties of the final munition. The formulation will also vary depending on the level of stabilization desired in the final munition. However, preferably, the composition comprises 5 to 80%, by weight, of perchlorate, 5 to 80% of the NENA plasticizer, and up to 40%, by weight of the stabilizer. More preferably, the composition comprises 5 to 45% perchlorate, 5 to 20% NENA, and 0.05 to 30% stabilizer. Most preferably, however, the composition comprises 0.5 to 5% stabilizer.

As is known in the art, sufficient binder may also be present in order to provide the composition with the desired handling properties.

When high explosives, as discussed hereinabove, are included as part of munition formulations, they may be present in any amount from 1 to 90%, by weight. However, the munition formulation preferably comprises from 60% to 80% by weight, of the high explosive.

EXAMPLES

The invention will now be described by way of example only, by reference to the following examples. In the examples, a key feature in the demonstration of the present invention, is the identification of increase stability of the munition in the presence of the stabilizer. This aspect of the examples is demonstrated using three different, although similar test procedures, which may be described as follows:

TEST 1

A 2 gram sample of a test material is placed under vacuum, heated to a temperature of 90° C., and held at that temperature for 48 hours. The amount of gas given off by the sample is measured and compared to the amount of gas given off by the various individual components of the sample. If no excess gasses above a specified level are given off by the sample within the 48 hour period, the sample is considered stable. This test is considered to be an industry standard, and is generally utilized throughout the industry as an indication of component compatibility. The test is described further in "Encyclopedia of Explosives and Related Items" Vol. 1, B. T. Federoff (editor) Picatinny Arsenal, Dover, N.J., 1960, p. xxvi.

TEST 2

A 2 gram sample of test material is heated to 90° C. under atmospheric conditions. The temperature of the sample is measured, and the time to a strong exotherm is recorded.

TEST 3

A 2 milligram (mg) sample of test material is placed in a differential scanning calorimeter (DSC) and heated to 140° C. Again, the time to exotherm is recorded.

Various formulations containing mixtures of ammonium perchlorate, NENA compounds, and various stabilizers were prepared and tested for stability using one or more of the test methods described hereinabove.

Samples of ammonium perchlorate (AP) and various NENA compounds were tested in accordance with test procedure No. 1 discussed hereinabove. Separately, each of the various components produced little measurable gas. A mixture of DINA and AP, however, reacted violently and gave off a relatively large amount of gas. Thus, since this is a standard measure of compatibility in the industry, the incompatibility of these ingredients was demonstrated.

Test 2 and 3 were devised in order to provide a more convenient method for establishing compatibility. Test samples were prepared by manual mixing of ingredients prior to being placed in test vessels.

The formulations and the test results, for stabilizers of the formula I, are presented in Tables I and II. The formulations and test results of the stabilizers of formula II are presented in Tables III and IV. For comparison, compounds similar to, but not falling within the scope of the present invention are included in the tables as further evidence of the unexpected utility of the claimed compounds.

TABLE 1

Comparison of various stabilizers using a 2 gram 90° C. isothermal test described in the text as test #2.

| Example | Mixture Description[a] | Total Weight (g) | Time to Exotherm (min) |
|---|---|---|---|
| A | DINA + AP | 2.02 | 240 |
| B | DINA + AP | 2.34 | 190 |
| C | DINA + AP + 2NDPA[b] | 2.05 | 225 |
| D | DINA + AP + Urea[c] | 2.04 | >1620 |
| E | DINA + AP + EC[d] | 2.07 | 1540 |
| F | MeNENA + AP | 2.01 | 600 |
| G | MeNENA + AP | 2.39 | 250 |
| H | MeNENA + AP + Urea | 2.02 | >1620 |
| I | MeNENA + AP + EC | 2.17 | 750 |

[a]See text regarding DINA and MeNENA. AP = Ammonium Perchlorate (1:1 ratio, by weight, of AP to DINA or MeNENA)
[b]2NDPA = 2-nitro diphenylamine (1%)
[c]Urea = Carbamide (1%)
[d]EC = N,N'-diethyl-N,N'-diphenylurea (1%)

TABLE 2

Comparison of stabilizers using a 140° C. isothermal DSC test method (see test #3 in the text)

| | | | Weights (mg) | | | |
|---|---|---|---|---|---|---|
| Sample | NENA | Stabilizer | NENA | AP | Stabilizer | Time to Exotherm (min) |
| A | DINA | — | 1.56 | 1.37 | — | 10 |
| B | DINA | — | .77 | .74 | — | 15 |
| C | DINA | — | .46 | .41 | — | 25 |
| D | DINA | 2NDPA[b] | 1.06 | 1.07 | .06 | 12 |
| E | DINA | Urea[c] | 1.29 | 1.18 | .03 | 102 |
| F | DINA | Urea[c] | .96 | 1.00 | .04 | 306 |
| G | DINA | Urea[c] | 1.13 | 1.10 | .06 | 184 |
| H | DINA | MNA[d] | 1.14 | 1.25 | .26 | 56 |
| I | DINA | EC[a] | 1.07 | 1.16 | .12 | 39 |
| J | DINA | MgO | 1.21 | 1.09 | .11 | 55 |
| K | DINA | Carbanilide[f] | 1.26 | 1.12 | .04 | 8 |
| L | DINA | Hexylamine | 1.21 | 1.08 | .60 | 21 |

TABLE 2-continued

Comparison of stabilizers using a 140° C. isothermal DSC test method (see test #3 in the text)

| Sample | NENA | Stabilizer | Weights (mg) NENA | AP | Stabilizer | Time to Exotherm (min) |
|---|---|---|---|---|---|---|
| M | DINA | Octadecylamine | 1.10 | 1.10 | .01 | 13 |
| N | DINA | Akardite II[g] | 1.05 | 1.01 | .09 | 50 |
| O | DINA | N,N'-di-n-butylurea | .99 | 1.06 | .03 | 42 |
| P | DINA | N-t-butylacetamide | .97 | 1.07 | .24 | 102 |
| Q | DINA | N,N'-diphenylcarbazide | 1.09 | .99 | .05 | 6 |
| R | DINA | Acetamide[h] | 1.15 | 1.14 | .14 | 182 |
| S | DINA | Acetamide[i] | 1.01 | 1.11 | .10 | 12 |
| T | DINA | Succinimide[j] | 1.14 | 1.07 | .13 | 15 |
| U | DINA | N,N'-diethyl-N,N'-diphenylurea | .96 | 1.04 | .06 | 41 |
| V | MeNENA | — | .94 | .94 | — | 21 |
| W | MeNENA | Urea[e] | 1.02 | 1.04 | .06 | 260 |
| X | MEN[a] | — | 1.7 | .97 | — | 19 |
| Y | MEN[a] | Urea[e] | .98 | 1.00 | .02 | 306 |
| Z | MEN[a] | Carbanilide[f] | 1.05 | 1.02 | .04 | 16 |
| AA | EtNENA | — | .98 | .97 | — | 21 |
| BB | EtNENA | Urea[e] | 1.01 | 1.00 | .02 | 124 |
| CC | BuNENA | — | .95 | .95 | — | 34 |
| DD | BuNENA | 2NDPA[b] | 1.07 | 1.03 | .01 | 28 |
| EE | BuNENA | Urea[e] | 1.01 | 1.00 | .03 | 169 |
| FF | Butyl | EC[a] | 1.04 | 1.10 | .04 | 52 |

[a]MEN is a mixture of MeNENA and EtNENA
[b]2-nitrodiphenylamine
[c]carbamide
[d]methylnitroaniline
[e]N,N'-diethyl-N,N'-diphenylurea
[f]N,N'-diphenylurea
[g]N,N'-diphenylmethylurea
[h]ethanamide
[i]N-phenylacetamide
[j]2,5-diketopyrrolidine

TABLE 3

Comparison of various stabilizers using a 2 gram 90° C. isothermal test described in the text as test #2.

| Example | Mixture Description[a] | Total Weight (g) | Time to Exotherm (min) |
|---|---|---|---|
| A | DINA + AP | 2.08 | 240 |
| B | DINA + A.P | 2.34 | 190 |
| C | DINA + AP + 2NDPA[b] | 2.05 | 225 |
| D | DINA + AP + NQ[c] | 2.05 | >7080 |
| E | DINA + AP + EC[d] | 2.07 | 1540 |
| F | MeNENA + AP | 2.01 | 600 |
| G | MeNENA + AP | 2.39 | 250 |
| H | MeNENA + A.P + NQ | 2.02 | 7080 |
| I | MeNENA + AP + EC | 2.17 | 750 |
| J | EtNENA + AP | 2.03 | 625 |
| K | EtNENA + AP + NQ | 2.03 | >7080 |

[a]See text regarding DINA, MeNENA and EtNENA. A.P = Ammonium Perchlorate (1:1 ratio, by weight, of AP to DINA, MeNENA or EtNENA)
[b]2NDPA = 2-nitro diphenylamine (1%)
[c]NQ = nitroguanidine (1%)
[d]EC = N,N'-diethyl-N,N'-diphenylurea (1%)

TABLE 4

Comparison of stabilizers using a 140° C. isothermal DSC test method (see test #3 in the text)

| Sample | NENA | Stabilizer | Weights (mg) NENA | AP | Stabilizer | Time to Exotherm (min) |
|---|---|---|---|---|---|---|
| A | DINA | — | 1.56 | 1.37 | — | 10 |
| B | DINA | — | .77 | .74 | — | 15 |
| C | DINA | — | .46 | .41 | — | 22 |
| D | DINA | 2NDPA[a] | 1.06 | 1.07 | .06 | 12 |
| E | DINA | NQ[b] | 1.18 | 1.22 | .13 | 127 |
| F | DINA | EC[c] | 1.07 | 1.16 | .12 | 39 |
| G | DINA | Carbanilide[d] | 1.26 | 1.12 | .04 | 9 |

TABLE 4-continued

Comparison of stabilizers using a 140° C. isothermal DSC test method (see test #3 in the text)

| Sample | NENA | Stabilizer | Weights (mg) NENA | AP | Stabilizer | Time to Exotherm (min) |
|---|---|---|---|---|---|---|
| H | BuNENA | — | .95 | .95 | — | 34 |
| I | BuNENA | 2NDPA[a] | 1.07 | 1.03 | .01 | 29 |
| J | BuNENA | NQ[b] | 1.07 | 1.04 | .07 | 112 |
| K | BuNENA | EC[c] | 1.04 | 1.10 | .04 | 52 |

[a]2-nitro diphenylamine
[b]nitroguanidine
[c]N,N'-diethyl-N,N'-diphenylurea
[d]N,N'-diphenylurea Table 1 contains experimental results obtained using the second test method described hereinabove. It can be seen that the results presented in this table include mixtures of various NENA compounds with ammonium perchlorate as well as a combination of various potential stabilizers. It should be noted that in all examples shown in Table 1, that the ratio of AP to NENA is 1 to 1, on a weight basis, and that the stabilizer, when used, was present at a level of 1% by weight, on the total weight of the mixture. The weight of material used in the test was approximately the same for all tests, and was approximately two grams. However there was some variation in weight as can be seen in Example A and B of Table 1. It can be seen from these two examples, that a difference in mass can provide different results; in this case, the increased mass resulted in a less "stable" result. This is to be expected in this type of test since a greater mass of material generates a greater amount of heat, but does not increase proportionally in surface area. Since the heat of reaction is dissipated primarily at the surface, there is a greater amount of internal heat available to initiate or accelerate any reactions.

Examples C, D and E, of Table 1, all represent the use of various stabilizer ingredients with the combination of DINA and ammonium perchlorate. Example C represents the use of a standard, prior art, stabilizing agent ingredient. It can be seen that there is little or no improvement in stabilization of the mixture. Examples D and E represent the situation wherein stabilizers in accordance with the present invention (namely urea and N,N'-diethyl-N,N'-diphenylurea (also known as "ethylcentralite" or "EC")) are tested in combination with the DINA/NENA mixture. It can be seen in both cases that the improvement in stability is highly significant. Of the two, however, it is apparent that urea provides superior results to the EC. However, EC does demonstrate some stabilizing action in this test. Further, it should be noted that example D, with urea, was discontinued after 1620 minutes with no indication of an appreciable exotherm.

Examples F to I of Table 1 repeat similar experiments, with the DINA/AP reaction system being replaced by a MeNENA/AP system. Similar results to those observed for the DINA/AP system were observed, with urea providing the most significant improvement in mixture stabilization.

Table II contains data generated on a number of different samples utilizing the test method described hereinabove as Test 3. Using the DSC, stability of the system was measured by recording the time to exotherm for each reaction system. More stable mixtures remain at that temperature longer before exhibiting an exotherm.

The weights of the components of the reaction mixtures are presented in the table.

Examples A to C exemplify the reaction system of DINA and AP as shown in Table 1. Again, it can be seen that increasing the mass of the sample results in a less "stable" result. Examples A to U contain information related to stabilizers for the system of DINA and AP. Examples V to FF describe reaction systems comprised of AP with various NENA compounds, as set out in the table.

For each different NENA compound exemplified, it should be noted that the addition of urea resulted in the most significant improvement in stability, while other materials, such as acetamide, also display some improvement in stability.

In Table III, various results from Table I are repeated in order for comparison to those results obtained, using test method 2, using nitroguanidine as stabilizer. The mixtures tested contained equal parts, by weight, of ammonium perchlorate and NENA stabilizer (MeNENA, DINA or EtNENA), and when added, 1% by weight of stabilizer. It can be seen from experiments D, H and K, that the addition of nitroguanidine provides munitions which are far more stable then mixtures of ammonium perchlorate and NENA alone, or ammonium perchlorate, NENA, and prior art stabilizers such as 2-nitrodiphenylamine or N,N'-diethyl-N,N'-diphenylurea.

Table IV provides stabilization test results for munitions containing nitroguanidine, according to test method 3. Various results from Table II are repeated for comparison purposes. Again, it can be seen that nitroguanidine provides improved stabilization over more traditional prior art stabilizer.

Having described specific embodiments of the present invention, it will be understood that modifications thereof may be suggested to those skilled in the art, and it is intended to cover all such modifications as fall within the scope of the appended claims.

The embodiments of the invention in which an exclusive property or privilege is claimed are defined as follows:

1. A composition comprising a mixture of a perchlorate and a NENA (nitratoethylnitramine) compound in combination with a Lewis base stabilizer compound.

2. A composition as claimed in claim 1 wherein said stabilizer is either i) a compound of formula I

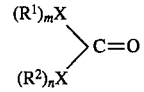

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) a compound of formula II

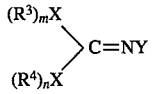

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

3. A composition as claimed in claim 1 wherein said NENA compound is a NENA (nitratoethylnitramine) compound substituted by an alkyl group containing 1 to 10 carbon atoms, or is substituted by a nitrate ester derivative.

4. A composition as claimed in claim 2 wherein said NENA compound is a NENA (nitratoethylnitramine) compound substituted by an alkyl group containing 1 to 10 carbon atoms, or is substituted by a nitrate ester derivative.

5. A composition as claimed in claim 3 wherein said NENA compound is selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof.

6. A composition as claimed in claim 4 wherein said NENA compound is selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof.

7. A composition comprising ammonium perchlorate, a NENA compound selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof, and a stabilizer compound of either:

i) formula I

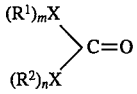

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) formula II

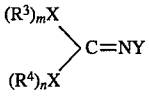

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

8. A composition as claimed in claim 7 wherein said stabilizer is urea, acetamide, or nitroguanidine, or combinations thereof.

9. A composition as claimed in claim 7 comprising 5 to 80%, by weight, of said perchlorate, 5 to 80% of said NENA compound, and up to 40%, by weight of said stabilizer compound.

10. A composition as claimed in claim 9 comprising 40 to 60% of said perchlorate, 5 to 45% of said NENA compound, and 0.05 to 30% of said stabilizer compound.

11. A composition as claimed in claim 10 comprising 0.5 to 5% of said stabilizer compound.

12. A munition comprising a mixture of ammonium perchlorate and a NENA (nitratoethylnitramine) compound in combination with a stabilizer compound, wherein said stabilizer is either i) a compound of formula I

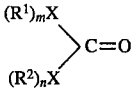

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) a compound of formula II

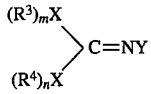

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

13. A munition as claimed in claim 12 wherein said NENA compound is a NENA (nitratoethylnitramine) compound substituted with an alkyl group containing 1 to 10 carbon atoms, or is substituted by a nitrate ester derivative.

14. A munition as claimed in claim 13 wherein said NENA compound is selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof.

15. A munition as claimed in claim 15 wherein said NENA compound is selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof.

16. A munition as claimed in claim 12 wherein said stabilizer is urea, acetamide, or nitroguanidine, or combinations thereof.

17. A munition as claimed in claim 12 wherein said high explosive is HMX (cyclotetramethylene tetranitramine), RDX (cyclo-1,3,5-trimethylene-2,4,6-trinitramine), PETN (pentaerythritol tetranitrate), TNT (trinitrotoluene), TATB (triaminotrinitrobenzene), or HNS (hexanitrostilbene).

18. A munition as claimed in claim 12 wherein the level of high explosive is between 60% to 80%, by weight, of the munition formulation.

19. A propellant comprising ammonium perchlorate, a NENA compound selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof and a stabilizer compound of either:

i) formula I

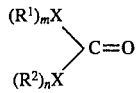

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) formula II

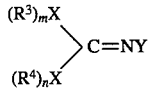

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

20. A propellant as claimed in claim 19 wherein said stabilizer is urea, acetamide, or nitroguanidine, or combinations thereof.

21. A propellant as claimed in claim 20 wherein said high explosive is HMX (cyclotetramethylene tetranitramine) or RDX (cyclo-1,3,5-trimethylene-2,4,6-trinitramine).

22. A process for the production of a stabilized ammonium perchlorate/NENA composition comprising blending a mixture of ammonium perchlorate and a NENA compound selected from N-butyl-N-nitratoethylnitramine (BuNENA), N-ethyl-N-nitratoethylnitramine (EtNENA), N-methyl-N-nitratoethylnitramine (MeNENA) or N,N'-dinitratoethylnitramine (DINA), or combinations thereof, together with a stabilizer compound of either:

i) formula I

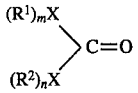

I wherein each X may independently be a direct link, or a carbon, nitrogen, —N—N—, silicon, sulphur or phosphorous atom, m and n may be 0, 1, 2 or 3, and $R^1$ or $R^2$ may, independently be hydrogen, amino or $C_1$ to $C_8$ alkyl, aryl, alkenyl or alkyne, which may be optionally substituted with halogen, nitro, nitrate ester, sulphonate, phosphonates, esters, ketones or aldehydes, with the proviso that when X is a nitrogen atom, or is —N—N—, and m or n, for the $R^1$ or $R^2$ group connected to said nitrogen atom or —N—N—, is 2, and one of the $R^1$ or $R^2$ groups connected to said nitrogen atom, or said —N—N—, is hydrogen, then the other of said $R^1$ or $R^2$ groups connected to the said nitrogen atom, or —N—N—, is not an aryl group;

or, ii) formula II

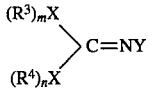

II wherein

X, m and n have the meanings set out for formula I, and $R^3$ and $R^4$ may, independently be hydrogen, nitro or $C_1$ to $C_8$ alkyl, aryl, alkenyl or alkyne, which may be optionally substituted with halogen, nitro, nitrate ester, sulphonate, phosphonates, esters, ketones or aldehydes, and Y may be hydrogen, or $C_1$ to $C_4$ alkyl, and wherein the compounds of formula I or II are Lewis bases.

* * * * *